United States Patent [19]

Larson et al.

[11] 4,215,706

[45] Aug. 5, 1980

[54] NICOTINE TRANSFER PROCESS

[75] Inventors: Thomas M. Larson, McLeansville; Thomas B. Moring, Jamestown; M. Sue Ireland, Greensboro, all of N.C.

[73] Assignee: Loew's Theatres, Inc., New York, N.Y.

[21] Appl. No.: 951,071

[22] Filed: Oct. 13, 1978

[51] Int. Cl.[2] ..... A24B 15/02

[52] U.S. Cl. ..... 131/143

[58] Field of Search ..... 131/143, 2, 144, 140 R, 131/140 C, 140 B, 15 C, 17; 546/282

[56] References Cited

U.S. PATENT DOCUMENTS

| | | | |
|---|---|---|---|
| 438,993 | 10/1890 | Endemann | 131/143 |
| 457,029 | 8/1891 | Johns | 131/143 |
| 729,218 | 5/1903 | Reimann | 131/143 |
| 1,557,768 | 3/1926 | Smith | 131/143 |
| 1,902,775 | 3/1933 | Herrmann | 131/143 |
| 2,162,738 | 6/1939 | McCoy | 131/143 |
| 2,429,567 | 10/1947 | Sowa | 131/140 R |
| 2,525,785 | 10/1950 | Feinstein | 546/282 |
| 2,580,568 | 1/1952 | Matthews et al. | 131/143 |
| 2,822,306 | 2/1958 | Beul et al. | 131/143 UX |
| 2,859,753 | 11/1958 | Hitchcock, Jr. | 131/143 |
| 3,139,435 | 6/1964 | Staley et al. | 131/143 |
| 3,147,200 | 9/1964 | Neel | 131/143 |
| 3,151,118 | 9/1964 | Moser | 131/143 UX |
| 3,338,248 | 8/1967 | Pavia | 131/143 |
| 3,390,685 | 7/1968 | von Bethmann et al. | 131/143 |
| 3,411,514 | 11/1968 | Hind et al. | 131/143 |
| 3,517,672 | 6/1970 | Michelson | 131/143 |
| 3,577,997 | 5/1971 | Bindig | 131/140 R |
| 3,631,865 | 1/1972 | Michelson | 131/143 |
| 3,782,393 | 1/1974 | Michelson | 131/143 |
| 3,863,645 | 2/1975 | Tso | 131/17 R |
| 4,020,850 | 5/1977 | Cogbill | 131/15 R |

*Primary Examiner*—V. Millin

*Attorney, Agent, or Firm*—Brumbaugh, Graves, Donohue & Raymond

[57] ABSTRACT

Tobacco (donor tobacco) is contacted with a receiving substrate which has been treated with a strong acid or an ammonium salt of a strong acid. Part of the nicotine in the donor tobacco is transferred from the donor tobacco to the receiving substrate. Thereafter the donor tobacco and the substrate may be separated. The donor tobacco has a reduced nicotine content and hence more desirable for use in a smoking product. Where the receiving substrate is a low nicotine tobacco by-product (or artificial smoking material) said substrate, enriched in nicotine as a result of the transfer, may be used as a filler material for smoking products.

14 Claims, No Drawings

NICOTINE TRANSFER PROCESS

The present invention relates to a novel and highly efficient nicotine transfer process, and, more particularly, to a process for transferring nicotine from a tobacco source to a nicotine deficient tobacco, a tobacco filler material, reconstituted tobacco (referred to as "reconstituted leaf" or "RL") or to a non-tobacco substance. The flavor of tobacco, RL or the like to which naturally occurring nicotine is transferred by the process, is usually improved and the receiving material is thus more desirable for use in a tobacco product. The nicotine source tobacco (from which nicotine is transferred) may, because of a lowered nicotine content, also be improved and more useful. The transfer process of the present invention is also useful outside the tobacco industry in that the nicotine-receiving material can be used as a nicotine source for various purposes unrelated to tobacco products.

Various techniques are known for producing nicotine free tobacco or a tobacco having a reduced nicotine content. Denicotinizing processes frequently employed are based either on the principle of direct solvent extraction of nicotine compounds whereby soluble compounds are washed out, or on the principle of leaching the tobacco with an alkaline aqueous solution which depends upon a chemical reaction to break down insoluble compounds which thereafter are washed out. Most, if not all of these prior art techniques, however, suffer from the fact that they significantly rob the treated tobacco of properties generally identified with a quality smoking product.

The process of the present invention offers a significant advance in tobacco technology by, for one thing, providing a simple, economical and effective process for reducing the nicotine content of tobacco without the usual accompanying degredation of the physical properties of the tobacco or smoke, such as the flavor, fragrance or burning qualities. Moreover, the process is useful for transferring naturally occurring nicotine from tobacco having a generally high nicotine content to a nicotine deficient tobacco, tobacco filler materials, or RL (reconstituted leaf) which are used in the production of cigarettes and other smoking products. It should be noted however that a low nicotine tobacco having properties which make it generally unusable can also be used as the nicotine donor in the present process.

In accordance with the invention, the material to which nicotine is to be transferred (receiving substrate) is contacted with a strong acid or an ammonium salt of a strong acid. The substrate is dried, and thereafter layered, mixed or otherwise contacted (depending upon the physical characteristics of the donor material and substrates) with the tobacco from which nicotine is to be transferred (hereinafter the "donor tobacco"). The combined donor tobacco and receiving substrate are then subjected to mild heating which rapidly effects a transfer of a significant percentage of the nicotine present in the donor tobacco to the substrate. Alternatively, the donor tobacco and receiving substrate may be stored at room temperature, in which case the nicotine transfer effected occurs more slowly.

Upon completion of the heat treatment or after a suitable storage period at room temperature, the donor tobacco, and the substrate, are cooled, if necessary, and the donor tobacco may be physically separated from the substrate on to which the naturally occurring nicotine given up by the donor tobacco has been fixed as a salt, i.e., a nicotine salt.

While the present process is not to be circumscribed by any particular reaction mechanism, it is proposed that possible mechanisms underlying the process involve the release of at least a portion of the nicotine in the donor tobacco either or both as a result of the exposure to heat and the decomposing salt deposited on the substrate and the subsequent reaction of the nicotine released from the donor tobacco with the strong acid to form a stable nicotine salt on the receiving substrate carrying the strong acid. Over long periods of time, as in storage, release of the nicotine apparently occurs in the same fashion and to the same extent, as occurs with heating, but more slowly due to the lower temperatures.

It has been found that as much as about fifty percent (50%) of the nicotine content of the donor tobacco can be transferred in accordance with the present process when the donor tobacco is combined with the receiving substrate and heated for as little as sixty (60) minutes at 90° C. As is apparent from the data in the Tables hereinbelow, the rate of heating, both as to time and temperature, affect the rate of the nicotine transfer and amount of nicotine which is transferred. Nevertheless, the presence or absence of heat in the reaction phase of the process appears not to be critical to the overall success of the process.

The substrate to which the nicotine is transferred is selected with a view to the desired objective of the transfer process with the physical and chemical characteristics of the process in mind. If the objective is to enrich the nicotine content of a tobacco substance (e.g., a low nicotine tobacco or RL), the selection to be made is clear from the objective. If the objective is to improve the donor tobacco, the receiving substrate selected should have physical and chemical properties compatible with the process, namely, non-reactivity with the acid or salt, the abilities to accept and retain the acid or salt, the ability to withstand heating (if transfer is to be accelerated by heating), the ability to be contacted effectively by mixing or layering with the source tobacco, the ability to be separated from the tobacco, and the ability to be further processed, if required, for an end use. Generally, a liquid-permeable sheet material, such as cloth, canvas or paper, is useful as a receiving substrate because such materials are able to hold the acid or salt and can be easily handled and separated from the donor tobacco.

In the tobacco industry, the process is especially attractive as applied in enriching the nicotine content of reconstituted tobacco leaf ("RL"). RL is made from tobacco scrap by-products which normally contain only 20% to 25% of the nicotine found in the average tobacco lamina and thus is an essentially non-nicotine filler source for cigarettes. By transferring nicotine from a donor tobacco source to the RL sheet, the RL is significantly improved as a filler, thus contributing to the quality of the cigarette.

The primary criterion for the selection of a suitably strong acid for use as a impregnant for the the substrate is that the acid should have a pKa of about 3.5 or less. Furthermore, non-volatile acids are generally preferred over the more volatile acids. Accordingly, preferred strong acids include phosphoric, tartaric, citric, sulfuric, malic, lactic, nitric and hydrochloric acids. When used alone as the impregnant the concentration of the acid solution should be in the range of about 1% to about 10%, with the preferred range being from about 5% to 10%. The amount of the acid impregnant deposited on the substrate may range from about 1% to 25% and preferably 10% to 25%.

Where the impregnant is a salt of a strong acid and strong base, the selection of the acid component is dictated by the foregoing parameters. The sole criterion for the selection of a suitable strong base depends on the presence of an ammonium cation; hence any ammonium salt of a strong acid will be suitable as an impregnant for the substrate. Preferred ammonium salts are mono and diammonium phosphate, diammonium sulfate, diammonium citrate and ammonium chloride. The concentration of the salt impregnant, like that of the acid generally ranges from about 1% to about 10%; however concentrations ranging from about 5% to about 10% are preferred. The amount of the salt deposited on the substrate can also range from about 1% to about 25% and preferably 10% to 25%. Accordingly, it has been found that at 5% acid or salt solution will deposit an amount of about 12% of the acid or salt impregnant by weight on the substrate, and a 10% acid or salt solution will deposit an amount of about 22% by weight of said acid or salt impregnant on the substrate. It should be noted, however that the actual amount of acid or salt deposited on the substrate depends somewhat on the porosity of the substrate material selected for use.

Any conventional method which adequately effects the impregnation of the substrate with a suitable strong acid or an ammonium salt of a strong acid may be used, dipping or spraying being exemplary. Moreover, the manner in which the donor tobacco and treated substrate are contacted is not critical as long as the two materials are interleaved or intermixed in reasonably intimate mutual contact.

When a combined mass of donor tobacco and treated receiving substrate is stored at room temperature, it has been found that after about five weeks a maximum nicotine transfer has been effected. Where the combined mass is heated, the applicable temperature is characterized as mild and ranges from anywhere from slightly above room temperature up to about 105° C., but preferably from about 60° C. to about 95° C. Temperatures in excess of 105° C. may and generally do result in some reduction in quality of the tobacco. The length of heating time is obviously dependent on the temperature used. However, as noted earlier, significant nicotine transfer has been effected in one hour at 95° C. At the upper range of temperatures which may be used, the heating phase should not exceed the amount of time required to effect the desired transfer to avoid possible degradation of the tobacco.

Any conventional technique based on size or density may be utilized to separate the donor tobacco from the substrate material. It should be recognized, however, that the selection of a suitable separation technique often depends on the type of the tobacco employed as the donor tobacco and especially the need to preserve the physical properties of both the tobacco and substrate.

From the foregoing discussion it can be seen that the process according to the invention, enables the manipulation of the nicotine content of tobacco materials, such as cut leaf and reconstituted leaf, by removal of nicotine from a suitable nicotine tobacco source or by the addition of nicotine to a low nicotine tobacco material. As mentioned above, however, the process may also be used to transfer nicotine from any donor tobacco source (be it high or low in nicotine content) for a myraid of other uses.

The economies of the nicotine transfer method disclosed herein should be apparent both from the simplicity and efficiency of the process as further illustrated by the examples described below.

EXAMPLE 1

A donor tobacco control was selected having a 6.0% nicotine content (by weight). A standard grade of absorbant cellulose sheet (laboratory filter paper) having a 0.0% nicotine content was chosen as the substrate control. The paper substrate was treated with 3% solution of diammonium phosphate and dried at room temperature. Thereafter it was determined that the amount of diammonium phosphate deposited was 7.0% by weight. Equal weights of cut donor tobacco (control) and the salt impregnated paper substrate were uniformly layered in two stacks, one of which was heated for one hour at 95° C. and the other for two hours at 95° C. After the heating stage, the stacks were allowed to cool to about room temperature, and the donor tobacco was mechanically separated from the substrate. Analysis of the nicotine content of the paper substrate gave the following data.

TABLE 1

| | Sample Description | % Nicotine |
|---|---|---|
| 1. | Treated paper substrate exposed to donor tobacco for 1 hour at 95° C. | 2.10% |
| 2. | Treated paper substrate exposed to donor tobacco for 2 hours at 95° C. | 2.65% |

EXAMPLE 2

The procedure of Example 1 was repeated except that the paper substrate was replaced by a reconstituted tobacco leaf (RL) substrate, having a 0.6% nicotine content by weight and the RL was treated with 4% solution of diammonium phosphate. After drying, it was found that the RL contained 9.0% by weight of deposited salt. Analysis of the nicotine content of the RL upon completion of the process gave the following data.

TABLE 2

| | Sample Description | % Nicotine |
|---|---|---|
| 1. | 1. Treated RL exposed to donor tobacco for 1 hour at 95° C. | 2.44% |
| 2. | Treated RL exposed to donor tobacco for 2 hours at 95° C. | 3.05% |

The data from the above Tables 1 and 2 demonstrate that the nicotine content was reduced in tobaccos deemed undesirably high in nicotine and transferred to both a porous paper and reconstituted leaf. Moreover, it can be inferred from the above data that the donor tobacco exposed to the diammonium phosphate treated RL (receiving substrate) under the conditions of Example 2 was reduced in nicotine by approximately 50%. Moreover, the exposed RL, previously deficient in nicotine, was significantly increased in nicotine content, i.e. from 0.6% to 2.44% and 3.05%.

The following experiments were conducted to confirm that substantially all of the nicotine lost by the donor tobacco migrates to the treated receiving substrate.

EXAMPLE 3

Reconstituted leaf (RL) having a nicotine content of 0.6% (by weight) was contacted with a 4.8% solution of diammonium phosphate. After drying it was determined that about 12% of the salt was deposited on the RL substrate. Two batches of mixed donor tobacco and impregnated substrate were prepared by layering the RL substrate between twice its weight of the donor tobacco, the nicotine content of which was 6.0% by weight. One mixture was heated for one hour at 95° C. and the other mixture was heated for two hours at 95° C. Thereafter both mixtures were cooled and separated.

EXAMPLE 4

Example 3 was repeated using a standard grade of laboratory filter paper as the receiving substrate and wherein the treated paper was layered with the same weight of donor tobacco.

EXAMPLE 5

Example 3 was repeated using a 4.8% solution of monoammonium phosphate.

EXAMPLE 6

Example 4 was repeated using a 4.8% solution of monoammonium phosphate.

Nicotine analyses of the RL, paper and donor tobacco used in accordance with procedures in Examples 3-6 are presented in Table 3.

TABLE 3

| | Sample Description | % Nicotine |
|---|---|---|
| 1. | Treated RL not exposed to tobacco (control) | 0.6% |
| 2. | Treated paper not exposed to tobacco (control) | 0.0% |
| 3. | Donor tobacco (control) | 6.0% |
| 4. | RL treated with DAP (diammonium phosphate) exposed 1 hour at 95° C. - [Example 3] | 2.6% |
| 5. | RL treated with DAP exposed 2 hours at 95° C. - [Example 3] | 3.0% |
| 6. | Paper treated with DAP exposed 1 hour - [Example 4] | 2.1% |
| 7. | Paper treated with DAP exposed 2 hours - [Example 4] | 2.6% |
| 8. | RL treated with MAP (monoammonium phosphate) exposed 1 hour at 95° C. - [Example 5] | 2.3% |
| 9. | RL treated with MAP exposed 2 hours at 95° C. - [Example 5] | 3.4% |
| 10. | Paper treated with MAP exposed 1 hour - [Example 6] | 2.0% |
| 11. | Paper treated with MAP exposed 2 hours - [Example 6] | 2.4% |
| 12. | Tobacco exposed to treated paper DAP 1 hour - [Example 4] | 3.8% |
| 13. | Tobacco exposed to treated paper DAP 2 hours - [Example 4] | 3.4% |
| 14. | Tobacco exposed to treated paper MAP 1 hour - [Example 6] | 3.6% |
| 15. | Tobacco exposed to treated paper MAP 2 hours - [Example 6] | 3.4% |

The data in Table 3 shows that the transfer process is highly efficient; i.e., very little nicotine is lost during the process. For Example, the total nicotine from samples 10 and 14 should equal 6.0%. The actual total is 5.6%. Table 4 summarizes the data in TABLE 3 to show the high efficiency of the present nicotine transfer process.

TABLE 4

| Sample Nos. | % Nicotine in sample | Total Nicotine % | Theoretical Total % | % Efficiency |
|---|---|---|---|---|
| 6 and 12 | 2.1 & 3.8 | 5.9 | 6.0 | 98 |
| 7 and 13 | 2.6 & 3.4 | 6.0 | 6.0 | 100 |
| 10 and 14 | 2.0 & 3.6 | 5.6 | 6.0 | 93 |
| 11 and 15 | 2.4 & 3.4 | 5.8 | 6.0 | 97 |

EXMAPLE 7

Separate samples of reconstituted leaf (RL) were dipped in 3% monoammonium phosphate solution (MAP), and 3% phosphoric acid solution (PA). In both instances, the amount of salt and acid deposited on the RL substrates was about 7% by weight. Both samples were exposed to the same type and grade of tobacco under the same conditions. TABLE 5 shows the results of nicotine analysis on the reconstituted leaf before and after exposure.

TABLE 5

| MAP | % Nicotine | PA | % Nicotine |
|---|---|---|---|
| RL not exposed to tobacco | 0.68% nic. | RL not exposed to tobacco | 0.68% N |
| RL exposed 1 hour at 95° C. | 1.20% nic. | RL exposed 1 hour at 95° C. | 1.00% N |
| RL exposed 2 hours at 95° C. | 1.41% nic. | RL exposed 2 hours at 95° C. | 1.27% N |

It can be seen from Table 5 that although phosphoric acid does facilitate nicotine transfer, it is somewhat less effective than the salt, monoammonium phosphate.

EXAMPLE 8

Reconstituted leaf (RL), having an 0.8% nicotine content was treated with diammonium phosphate. On drying it was determined that the RL contained 3.5% DAP. Said treated RL substrate was thereafter exposed to scrap tobacco containing 1.38% nicotine (sixty-four pounds of scrap and ten pounds of treated RL) for nine days at 105° F. (or 40° C.). The RL was separated from the scrap and analyzed for nicotine and found to contain 1.6% nicotine. Since original RL contained 0.8% nicotine, the nicotine content was doubled. The nicotine enriched RL was then made into 100% RL cigarettes and evaluated for smoking quality versus untreated RL. The judgment by a panel of experts was that the smoke of the enriched RL cigarettes possessed greater nicotine impact (desirable) and more tobacco character than the untreated RL cigarettes and therefore were judged superior.

TABLE 6

The following table provides data on the comparative effectiveness of various acids and salts in regard to migration or transfer of naturally occurring nicotine. RL samples, each containing 7% by weight of the following compound were mixed with tobacco having 2.25% nicotine at a ratio of 4 parts tobacco to 1 part RL.

| Additive | 1 hr. at 80°-85° C. % N | 2 hrs. at 80°-85° C. % N | 18hrs. at 80°-85° C. % N | 1 hr. at 105° % N | 1 hr. at 105° % N | 2 ½ hrs. at 105° % N |
|---|---|---|---|---|---|---|
| Citric acid | 0.97 | 0.95 | 1.76 | 1.30 | 1.25 | 1.83 |
| Malic acid | 0.93 | 1.18 | 1.68 | 1.35 | 1.35 | 1.69 |
| Sulfuric acid | 0.85 | 1.02 | 2.40 | 1.52 | 1.60 | 1.58 |
| Hydrochloric acid | 0.75 | 0.85 | 2.14 | 1.27 | 0.89 | 2.33 |
| Tartaric acid | 0.94 | 0.90 | 1.68 | 1.10 | 1.06 | 1.47 |
| Nitric acid | 0.85 | 1.07 | 3.41 | 1.40 | 1.69 | 2.98 |
| $NH_4$-chloride | 0.63 | 1.50 | 3.25 | 1.89 | 1.85 | 2.78 |
| $(NH_4)_2SO_4$ | 1.02 | 1.37 | 2.59 | 1.61 | 1.75 | 2.78 |
| D.A.P. | 0.94 | 1.25 | 2.10 | 1.57 | 1.40 | 2.10 |
| RL control (no treatment) | 0.77 | 0.79 | .71 | 0.80 | 0.80 | 0.70 |

What is claimed:

1. A process for transferring nicotine from a donor tobacco to a substrate comprising the steps:
   (a) contacting the substrate with a solution of a strong acid or an ammonium salt of a strong acid in order to impregnate or deposit on the substrate an amount of said acid or salt;
   (b) drying the substrate; and
   (c) contacting the donor tobacco with the substrate under effective conditions for a length of time sufficient to effect a transfer of nicotine from the donor tobacco to the substrate.

2. A process according to claim 1, wherein the pKa of the strong acid is about 3.5 or less.

3. A process according to claim 2 wherein the strong acid is selected from the group consisting of phosphoric, tartaric, citric, sulfuric, malic, and lactic acids and combinations thereof.

4. A process according to claim 1, wherein the ammonium salt of the strong acid is selected from the group consisting of diammonium phosphate, diammonium sulfate, diammonium citrate, ammonium chloride and combinations thereof.

5. A process according to claim 1, wherein the concentration of the strong acid or ammonium salt of a strong acid with which the substrate is contacted, ranges from about 1% to about 10%.

6. A process according to claim 5, wherein said concentration ranges from about 5% to about 10%.

7. A process according to claim 1, wherein the amount of strong acid or ammonium salt of a strong acid deposited on or impregnated in the substrate ranges from about 1% to about 25% by weight.

8. A process according to claim 7 wherein the amount of acid or salt deposited on or impregnated in the substrate is from about 10 to 25% by weight.

9. A process according to claim 1, wherein the donor tobacco and substrate are contacted by mixing said tobacco and substrate so that said materials are in substantial intimate mutual contact.

10. A process according to claim 1, wherein the donor tobacco and substrate while contacting each other are heated at a temperature not in excess of about 105° C.

11. A process according to claim 10, wherein the temperature ranges between about 60° C. to about 95° C.

12. A process according to claim 1, wherein the donor tobacco and substrate while in contact with each other are stored at room temperature.

13. A process according to claim 1, wherein the substrate is a tobacco substance.

14. A process according to claim 1, wherein the substrate is a non tobacco substance.

* * * * *